US006241607B1

(12) United States Patent
Payne et al.

(10) Patent No.: US 6,241,607 B1
(45) Date of Patent: Jun. 5, 2001

(54) NON-RECTANGULAR AND/OR NON-ORTHOGONAL ARRANGEMENT OF GAMBLING ELEMENTS IN A GAMING APPARATUS

(75) Inventors: Tony Payne; Mark C. Nicely, both of San Francisco, CA (US)

(73) Assignee: Silicon Gaming-Nevada, Las Vegas, NV (US)

( * ) Notice: Subject to any disclaimer, the term of this patent is extended or adjusted under 35 U.S.C. 154(b) by 0 days.

(21) Appl. No.: 09/397,447

(22) Filed: Sep. 16, 1999

Related U.S. Application Data

(60) Provisional application No. 60/100,612, filed on Sep. 16, 1998.

(51) Int. Cl.[7] ..... A63F 9/22

(52) U.S. Cl. ..... 463/20; 463/21; 273/143 R

(58) Field of Search ..... 463/1, 9–13, 16, 463/20, 21, 23, 25, 30, 36, 37; 273/143 R, 292, 293, 139, 138.1, 138.2

(56) References Cited

U.S. PATENT DOCUMENTS

| | | | | |
|---|---|---|---|---|
| 4,198,052 | * | 4/1980 | Gauselmann | 273/143 R |
| 5,580,053 | * | 12/1996 | Crouch | 463/20 |
| 5,611,535 | * | 3/1997 | Tiberio | 273/143 R |
| 5,807,172 | * | 9/1998 | Piechowiak | 463/20 |
| 6,004,208 | * | 12/1999 | Takemoto | 463/20 |

* cited by examiner

*Primary Examiner*—Mark Sager
(74) *Attorney, Agent, or Firm*—Oppenheimer, Wolff & Donnelly LLP; Claude A. S. Hamrick

(57) ABSTRACT

An improved multiple payline gaming method and apparatus wherein a multiplicity of independently driven symbol carrying elements are arranged in a non-orthogonal and/or non-rectangular array and are combined with a plurality of individually selectable paylines intersecting various combination of the elements so as to give a game player various degrees of latitude in choosing potential outcomes available as a result of each gaming proposition. Means may also be provided for allowing selection of special payout opportunities based upon certain positional relationships between various ones of the elements and their displayed symbols.

20 Claims, 6 Drawing Sheets

NON-RECTANGULAR AND/OR NON-ORTHOGONAL ARRANGEMENT OF GAMBLING ELEMENTS IN A GAMING APPARATUS

RELATED APPLICATIONS

This application claims the benefit of U.S. Provisional Application No. 60/100,612, filed Sep. 16, 1998, entitled "Non-Rectangular And Non-Orthogonal Arrangement Of Gambling Elements".

FIELD OF THE INVENTION

This invention relates generally to gaming methods and apparatus of the slot machine type, and more particularly, to an improved multiple payline gaming method and apparatus wherein a multiplicity of independently driven symbol carrying elements are arranged in a non-orthogonal and/or non-rectangular array and are combined with a plurality of individually selectable paylines intersecting various combination of the elements so as to give a game player various degrees of latitude in choosing potential outcomes available as a result of each gaming proposition. Means may also be provided for allowing selection of special payout opportunities based upon certain positional relationships between various ones of the elements and their displayed symbols.

BACKGROUND OF THE INVENTION

In typical multiple payline gaming devices such as the slot machines found in many casinos throughout the world, a play field, face plate, video screen or other display means including a plurality of three, four or five reels, or other rotating objects or images thereto is often provided for either real or virtual spin operation. Each such object contains at least one symbol which, upon stoppage of the object's rotation, may align with one or more horizontally or diagonally extending paylines. The symbols aligned along a particular payline, when compared to a pay table, then determine the result of a gambling proposition. For example, if the gaming device is a three reel apparatus wherein, upon stopping of its rotation, each reel reveals three play symbols at a time, the device may contain up to three horizontal paylines and two diagonal paylines where each payline encompasses or extends across three play symbols at a time; i.e., one symbol or space therefor on each reel. Such an array is illustrated in FIG. 1 of the drawing and includes three reels 10–14 of a type usually positioned behind a real or virtual face plate 16 having windows or sets of windows 18–22 for revealing one or more reel carried symbols on each reel. The reels are independently driven and stopped at random positions by a reel drive system 23. The face plate 16 is also inscribed with 3 horizontal paylines 24–28 and 2 diagonal paylines 30 and 32. Note that each payline crosses a window or symbol location (or space therefor) on each reel. Although arguably such apparatus could also include additional diagonal paylines, crossing only two of the reels, no such payline configuration is known to exist. Note that in the illustrated arrangement, it would not be feasible to have vertical paylines, even though three play symbol locations would lie beneath the intersected windows, because the relationship between the three adjacent symbols on each reel is fixed and clearly not a random organization of elements.

Games of the illustrated type do not provide the player with play choices other than that directly associated with the number of coins or credits wagered. Since many players would enjoy the opportunity to make multiple wagers per play proposition, it will be appreciated that the prior art arrangement of reels, play symbols and paylines is rather limiting. There is therefore a need to provide a gaming element arrangement in which substantially more choice is given to the player in terms of selection of paylines and play volatility. This would be advantageous to the player in that his perceived chances of winning would be enhanced. At the same time, such an arrangement would be beneficial to the game proprietor in that it would tend to increase the number of wagers made by a player per play proposition.

SUMMARY OF THE INVENTION

It is therefore an object of the present invention to provide a novel arrangement and utilization of multiple paylines and symbol carrying elements within a slot machine or similar device so as to increase the wagering opportunities that a player may make per play proposition.

Another object of the present invention is to provide a gaming method and apparatus of the type described wherein a player can increase his perceived odds of winning by selecting paylines which have a higher probability of winning but lower payout, or can select paylines that have a lower probability of winning but a higher payout.

Briefly, a preferred embodiment of the present invention includes the provision of a play field or screen having a plurality of independently and randomly changeable gaming elements arranged in a non-rectangular and/or non-orthogonal array, together with multiple, individually selectable paylines in the vertical, horizontal and/or diagonal directions so as to enable a player to have greater choice of play volatility. The illustrated symbol carrying elements may be real or virtual depictions of objects such as spinning reels, flipping cards, flipping dice, dominoes, etc.

An advantage of the present invention is that it offers the opportunity to present a unique wagering system whereby a player may wager on any of a plurality of selected outcome types.

Another advantage of the present invention is that it enables a player to select different levels of win probability versus win payout per gaming proposition.

These and other objects and advantages of the present invention will no doubt become apparent to those skilled in the art after having read the following detailed disclosure of the several embodiments illustrated in the several figures of the drawing.

IN THE DRAWINGS

Figure 1:
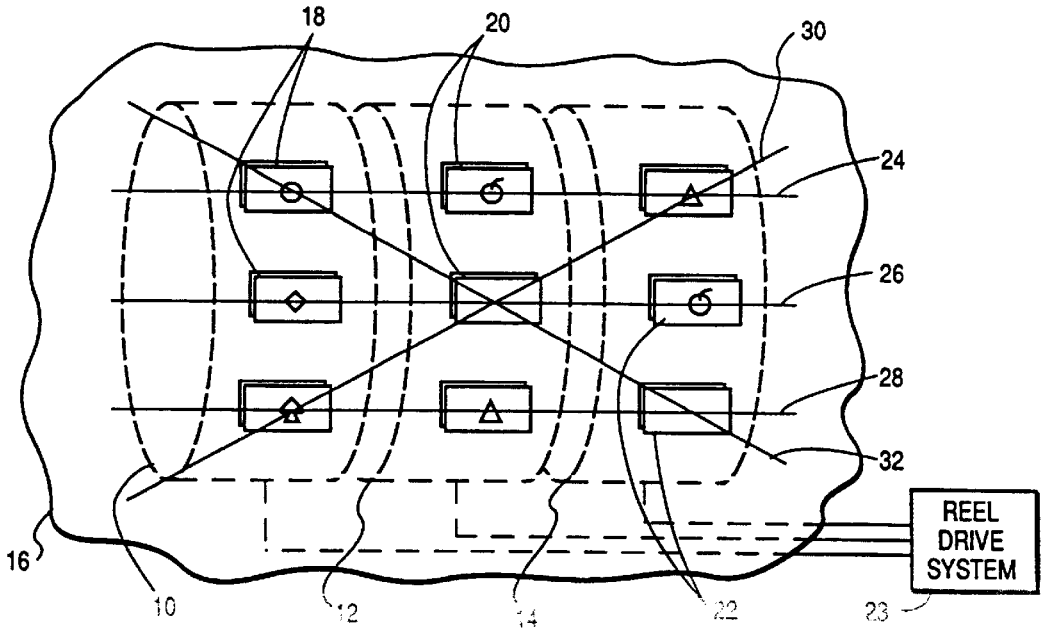
Fig. 1 (PRIOR ART)
FIG. 1 is a depiction of a prior art three-reel game having multiple paylines, each of which crosses one of the three elements of each reel.
Figure 2:
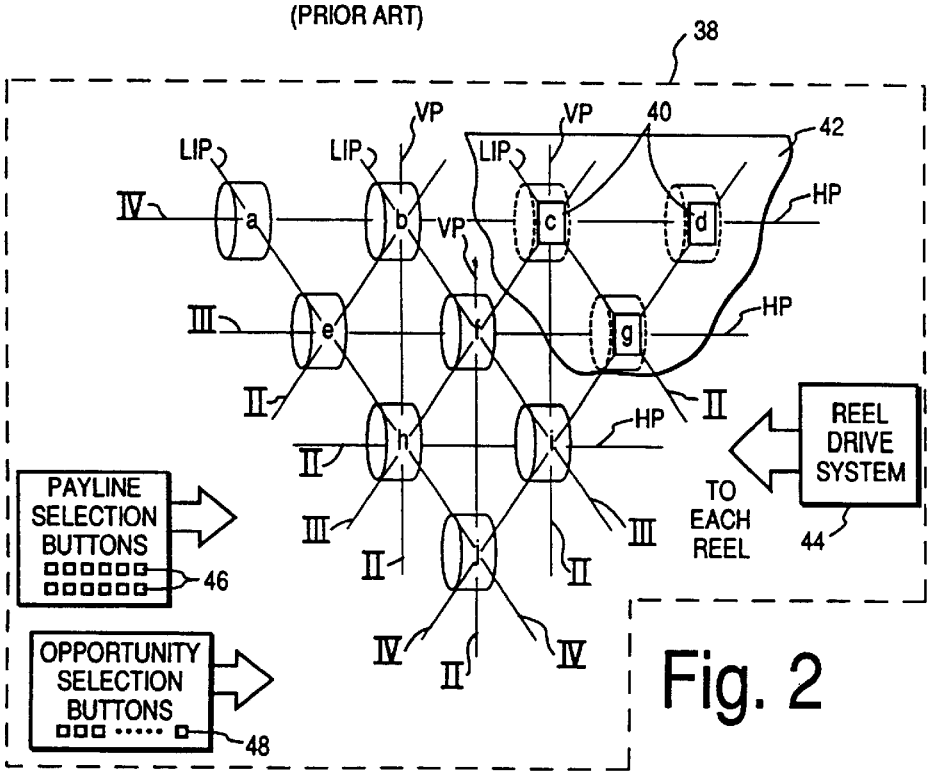
FIG. 2 is a schematic depiction of a ten-reel embodiment of a multiple reel, multiple payline game with the reels arranged in a triangular array in accordance with the present invention.
Figure 2A:
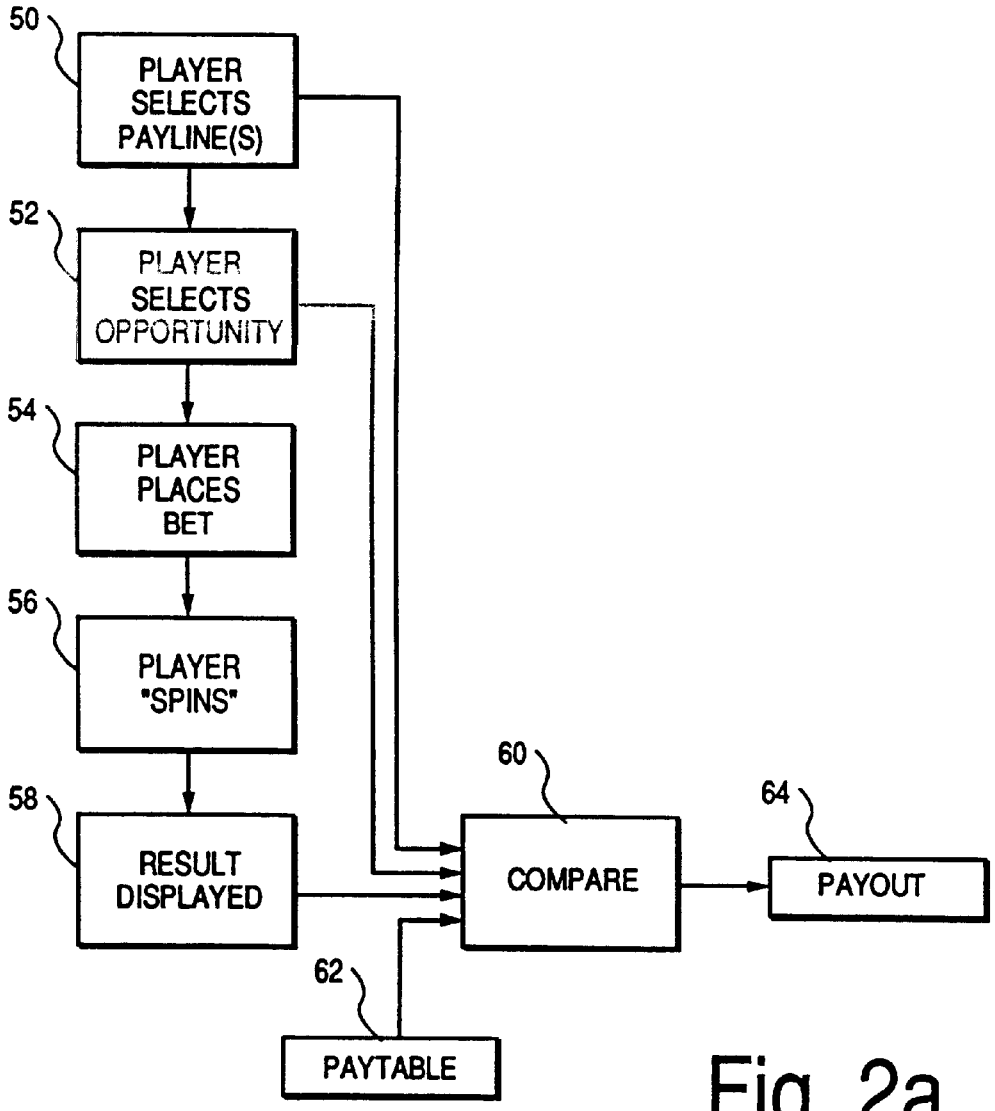
Figure 3:
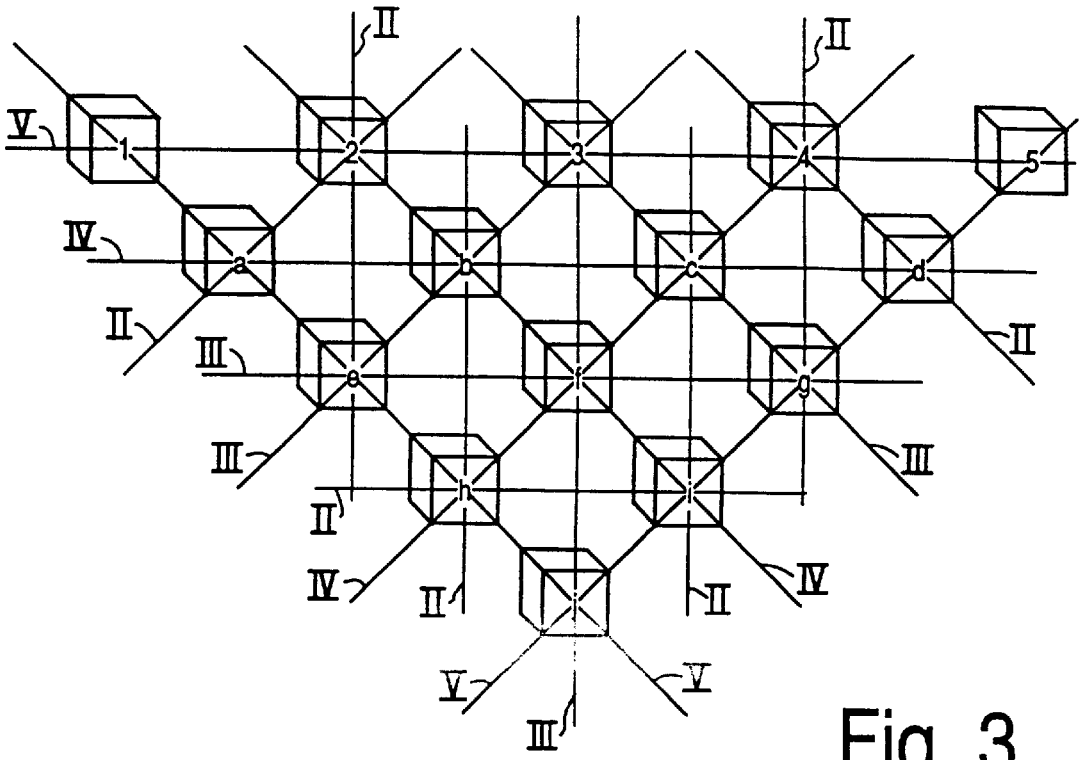
Figure 4:
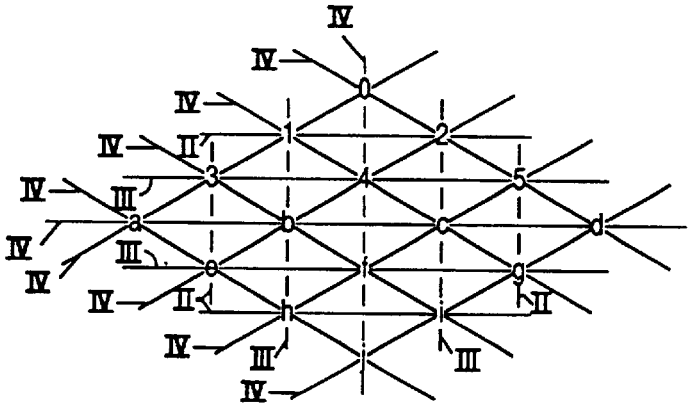

FIG. 2*a* is a block diagram illustrating a method of operation in accordance with the present invention;

FIG. 3 illustrates a 15-element of a multiple element, multiple payline gaming embodiment organized in a triangular array in accordance with the present invention;

FIG. 4 illustrates a 16-element embodiment of a multiple element, multiple payline game organized in a diamond shape in accordance with the present invention; and FIGS. 5–9 illustrate further alternative embodiments of multiple element, multiple payline gaming layouts in accordance with the present invention.

DETAILED DESCRIPTION OF THE PREFERRED EMBODIMENTS

Turning now to FIG. 2 of the drawing, a multiple element, multiple payline gaming field or screen is schematically depicted at 38 to include 10 reels or other rotatable or otherwise changeable gaming elements designated 1–j, each having at least one gaming symbol, or a blank space in place thereof, revealed one at a time, or through a play window 40 perhaps formed in a real or virtual "cover plate" 42. Hereinafter it will be understood that when the term "element" is used, it means any type of gaming element, such as for example, spinning reels, playing cards, dice, dominoes, etc., having the capability of displaying one or more gaming symbols (or the lack thereof) per element, displayable one at a time. Each of the reels are independently and randomly driven by a reel drive system 44 so that all combinations of symbols revealed in the several windows are likewise random in occurrence. This non-orthogonal, non-rectangular, triangular array of elements includes three horizontal paylines "HP", three leftwardly inclined paylines "LIP", and three rightwardly inclined paylines "RIP" all respectively, intersecting four, three and two sets of adjacent windows, and three vertical paylines "VP", each intersecting two non-adjacent windows separated by a horizontal row of elements. This arrangement is unique in that it can include up to twelve multi-symbol paylines designated II, III and IV having between two and four symbols per payline. For example, the illustrated field is comprised of three paylines IV including the four symbols: a–j, j–d, a–d; three 3 symbol paylines III including: bfi, hfc and efg; and 6 two symbol paylines II including: be, bh, fj, ci, cg and hi. Appropriate buttons 46, or other suitable player input means are provided to accommodate the payline selection. A game such as this might be organized to pay the player awards listed on a paytable (not shown) setting fourth certain combinations of symbols indicating winning combinations when such combinations are aligned along particular player selected paylines. For example, there could be various types of awards for obtaining 1) 4 matching symbols on up to four selectable symbol paylines IV;
2) 3 matching symbols on up to three selectable symbol paylines III;
3) 3 contiguous matching symbols on any selectable four symbol payline IV;
4) 2 contiguous matching symbols on any selectable three III or four IV symbol paylines (wherein one of the symbols could be required to be at the edge of a payline);
5) 1 contiguous matching symbol on selected adjacent three III or four IV symbol paylines (where one of the symbols could be required to be at the edge of a payline); and
6) 2 matching symbols on selected two symbol paylines II.

This game could also offer the following kinds of propositions:

a) Player places one wager on the entire game, i.e., covering all available paylines.
b) Player places wagers on only selected paylines. Since different paylines offer different payout opportunities (based on whether the payline covers 2, 3 or 4 symbols), this allows the player to structure his wager according to the selected payout opportunities.
c) Player places wagers on different kinds of outcome opportunities. For example, he can place independent wagers for any of the outcome types 1, 2, 3, 4, 5 or 6 listed above by selecting control inputs in the form of additional outcome opportunity buttons 48 that are provided in addition to the payline selection buttons 46.

It will thus be appreciated that the present invention is a substantial departure from the prior art multiple payline games wherein the paylines are only selected as a direct result of the number of coins or credits wagered. In contrast, this invention allows not only individual selection of one or more particular paylines, it also permits the player to select various payout opportunities (outcome types).

By way of example, a possible play scenario in accordance with the present invention is depicted in FIG. 2*a*. As suggested by block 50 of this diagram, the player would first select paylines to be included in his wager. If he chooses, he can also select a particular outcome opportunity level (block 52) or play at a default level. He then places his bet (block 54) by inserting coins or other means of payment, or attributes credits, followed by the activation of a "spin" button, handle pull or other input command (block 56). The reel drive system of the gaming device will then individually and independently "drive" each of the several gaming elements to new display states that will collectively represent a new random output display (block 58). A results comparator 60 then compares the states of the displayed elements in the selected paylines to a paytable and determines a corresponding payout (block 64) adjusted to reflect any selected opportunity level inputs.

In FIG. 3, a 15-element field is illustrated, again having a non-orthogonal, non-rectangular, triangular array configuration. In this embodiment, the gaming elements 1–j are shown as being comprised of multiple die having a plurality of faces, each of which includes a different symbol. The horizontal, vertical and inclined paylines can include:

up to three five symbol paylines V: 1–j, 1–5, j–5;

up to three four symbol paylines IV: 2–i, h–4, a–d;

up to four three symbol paylines III: eb3, 3fj, 3cg, eft; and up to seven two symbol paylines II: 2*a*, 4*d*, hi, bh, ze, 4*j*, ci.

This game could include the same kind of proposition opportunities as in the ten reel game of FIG. 2 with additional extensions to support for example, 3, 4 and 5 contiguous matching symbols on a 5-symbol line; 2, 3 and 4 contiguous matching symbols on a 4 symbol line; etc.

FIG. 4 schematically illustrates a 16-element "diamond" shaped configuration including elements 0–j. This combination offers:

up to 10 paylines IV of 4 symbols each: 0–j, 3–i, 1–g, 0–d, a–0, e–2, h–5, j–d, a–j, a–d;

up to four paylines III of 3 symbols: 1*b*, hb, 2*ci*, 345, efg; and up to four paylines II of 2 symbols: 12, hi, 3*e*, 5*g*.

Note that not all of these paylines need to be offered for this arrangement to be innovative.

Figure 5:
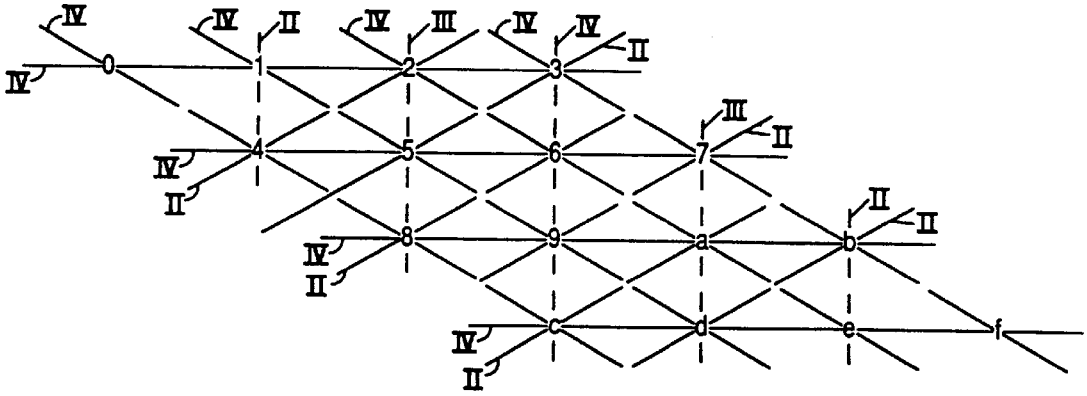

In FIG. 5, a skewed parallelogramic array of 16 elements 0–f is illustrated which provides for:

up to 9 four element paylines IV: 0–3, 4–7, 8–b, c–f, 0–c, 1–d, 2–e, 3–f, and 3–c;

up to 2 three element paylines III: 2–8 and 7–d; and up to 8 two element paylines II: 1–4, 2–4, 3–5, 6–8, 7–9, a–c, b–d and b–e.

Figure 6:
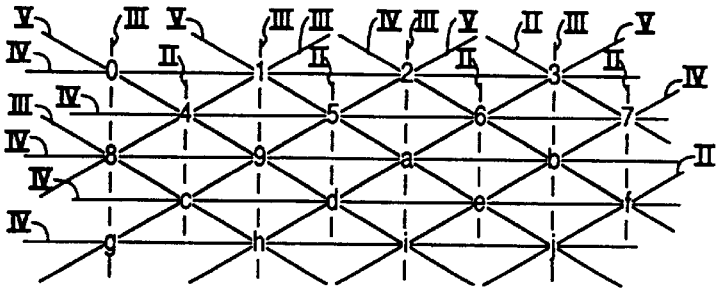

FIG. 6 illustrates a 20-element laterally offset line array, including elements 0–j, which provides payline possibilities of:

up to 4 five symbol paylines IV: 0–i, 1–j, g–2, h–3;

up to 7 four symbol paylines IV: 0–3, 4–7, 8–b, c–f, g–j, i–7 and 2–f; and up to 4 two symbol paylines II: 4–c, 5–d, 6–e and 7–f.

Figure 7:
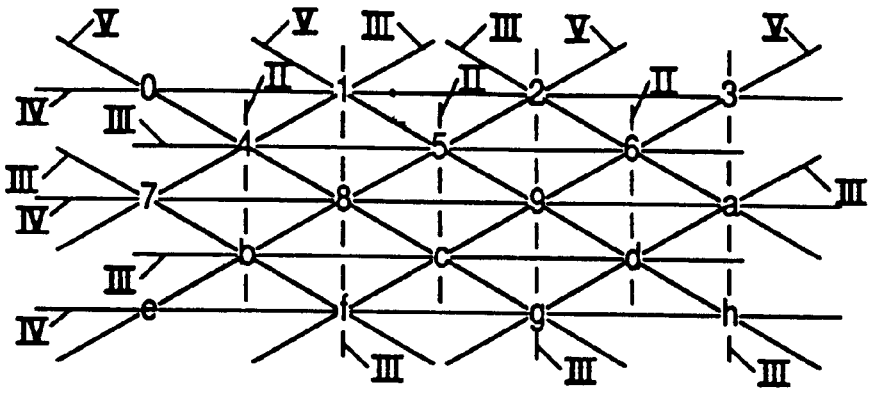

In FIG. 7 an 18-element array is depicted including elements 0–h and comprised of alternating horizontal lines of 4 and 3 elements, which includes up to 4 five symbol paylines V: 0–g, 1–h, e–2 and f–3;

up to 3 four element symbol paylines IV: 0–3, 7–a and e–h;

up to 10 three element paylines III: 4–6, b–d, 7–f, 2–a, 0–e, 1–f, 2–g, 3–h, 7–1 and g–a; and up to 3 two symbol paylines II: 4–b, 5–c and 6–d.

Figure 8:
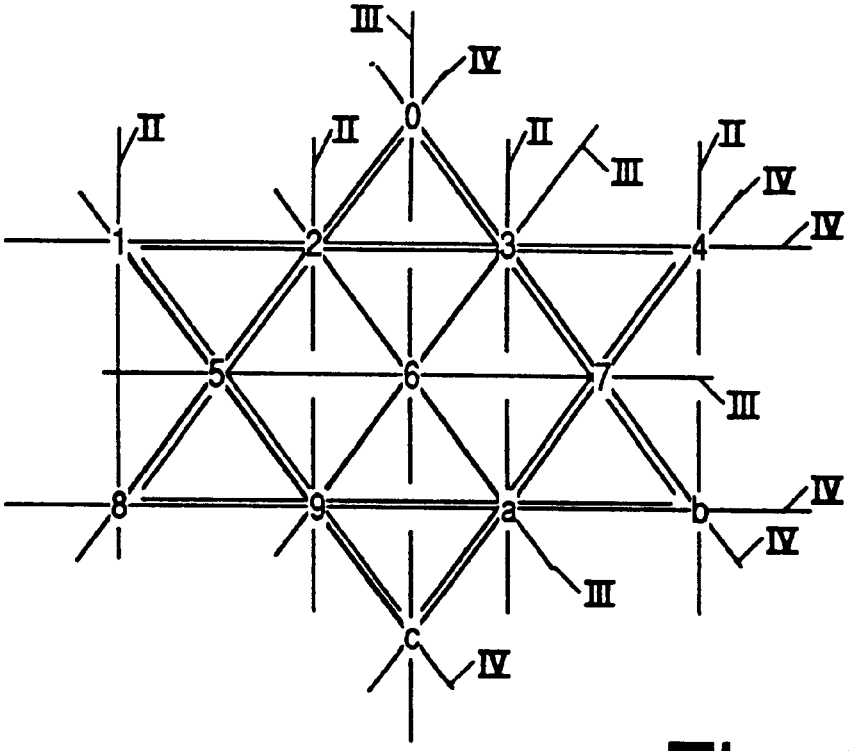

In FIG. 8 a 13-element "star-configured" array is depicted including elements 0–c, which provides for:

up to 6 four element paylines IV: 1–4, 1–c, c–4, 0–8, 0–b and 8–b;

up to 6 three element paylines III: 8–4, 1–b, 0–c, 4–8, 5–7, 2–a and 3–9; and up to 4 two element paylines II: 2–9, 3–a, 5–a and 2–7.

Note that in this embodiment the element "6" could be treated as a "wild card" or special purpose element which might carry a special bonus weighting or be separately selectable as a special "opportunity element."

Figure 9:
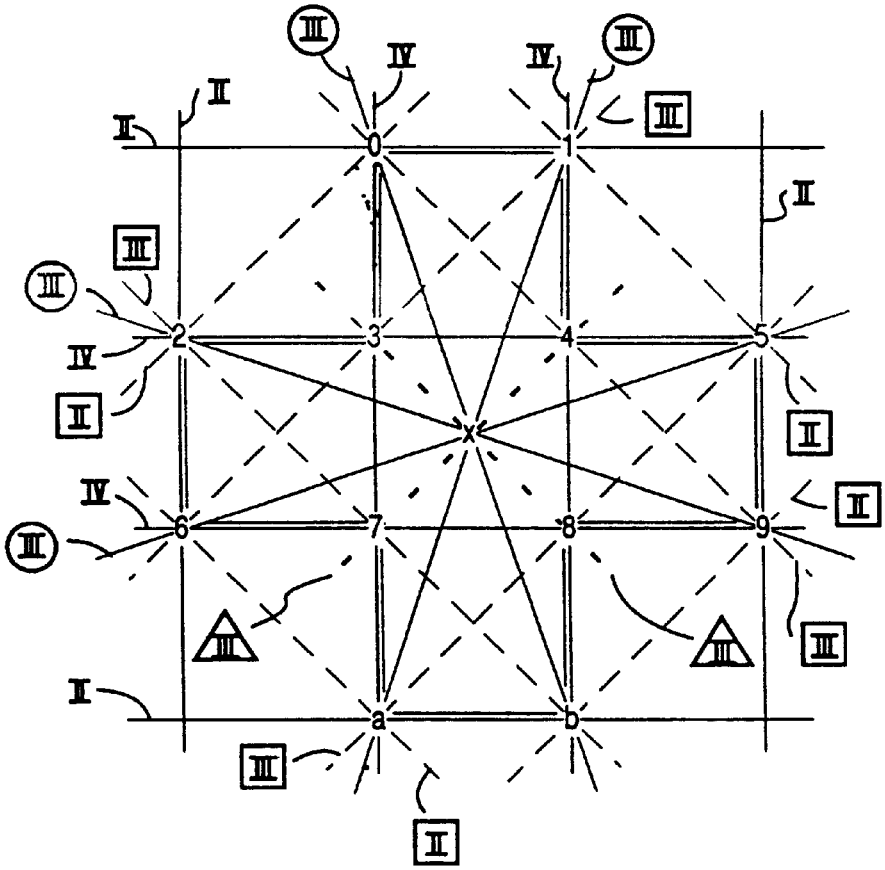

In FIG. 9 a nine element "cross" shaped configuration is depicted including the elements 0–b plus an extra center positioned element "X" that could be used as a bonus element. The various combinations of this configuration are labeled as multiple "layers" of elemental paylines wherein II, III and IV illustrate vertical and horizontal payline combinations; paylines designated by the encircled III's represent diagonal paylines passing through the center point X; the triangularly encompassed paylines III represent additional diagonal paylines passing through the center element X, and rectangularly circumscribed II's and III's represent other possible diagonal paylines not passing through "X".

It will of course be appreciated that still other arrangements and variations including triangle versus diamond versus irregular rectangular versus cross versus snowflake versus pentagon, configuration, etc., may also be used in accordance with the present invention Moreover, the orientation of the arrays may be varied. For example, the direction of pointing of a triangular array might have a special significance. In addition, geometric figures formed by intersecting lines of the arrays could be emphasized and telescopically nested such that an outer ring of intersecting paylines might have one significance, where an encircled inner ring of intersecting paylines would have another significance. Moreover, the use of paylines of differing lengths could have a significance versus use of paylines of the same length in certain configurations.

This invention thus provides a novel gambling array and payline selection method and apparatus in which numerous choices of play propositions are presented to the player either alone or in combination with a scheme of win frequency/probability, selections that makes the game much more interesting.

Although the present invention has been described above in terms of several alternative embodiments, it is to be understood that such illustrations are not considered to be exhaustive. It is however intended that the following claims be broadly interpreted as covering all alterations, variations, extensions and alternatives as fall within the true spirit and scope of the invention.

What is claimed is:

1. A gaming display for use in a gaming apparatus comprising:

a plurality of individually driven real or virtual symbol carrying elements disposed in a non-orthogonal positional array; and a plurality of individually selectable paylines respectively intersecting different combinations of said elements of said array, whereby the outcome of a gaming sequence using said display is a function of the symbols displayed along a selected one or more of said paylines.

2. In a gaming apparatus including a play field having an arrangement of multiple symbol carrying elements positionally organized to display gaming proposition outcomes at windows/locations disposed along one or more paylines, a player input interface, means responsive to the player input interface for causing the elements to present a random display of the symbols carried thereby, and means for comparing the symbols displayed along the paylines to a pay table to determine and award earned winnings to the player, an improved play field arrangement comprising:

a plurality of individually driven real or virtual symbol carrying elements for displaying at corresponding display windows/locations a single symbol, or a lack thereof, per gaming proposition, said windows/locations being arranged in a non-orthogonal array; and a plurality of individually selectable paylines respectively intersecting different combinations of said windows/locations;

whereby depending upon his selection of one or more of said paylines, a player can influence the probability of payout per proposition.

3. In a gaming apparatus as recited in claim 2 wherein said non-orthogonal array of windows/locations is a triangular array having alternating odd and even numbers of windows/locations disposed along mutually parallel paylines.

4. In a gaming apparatus as recited in claim 3 and further including inclined paylines angularly intersecting windows/locations contained in adjacent ones of said horizontal paylines.

5. In a gaming apparatus as recited in claim 4 and further comprising vertical paylines intersecting windows/locations disposed in alternating ones of said horizontal paylines.

6. In a gaming apparatus as recited in claim 2 wherein said symbol carrying elements are selected from the group consisting of reels, dice, dominoes and cards.

7. In a gaming apparatus as recited in claim 2 wherein said array of windows forms a diamond shaped array including horizontally extending paylines, vertically extending paylines and oppositely inclined diagonally extending paylines, each of said diagonally extending paylines intersecting at least two windows/locations of said horizontal and vertical paylines.

8. In a gaming apparatus as recited in claim 2 wherein said non-orthogonal array is also non-rectangular and includes a plurality of horizontally extending paylines intersecting equal numbers of windows/locations, a plurality of vertically extending paylines intersecting unequal numbers of windows/locations, and first set of inclined paylines intersecting equal numbers of windows/locations, and second set of inclined paylines intersecting equal numbers of windows/locations.

9. In a gaming apparatus as recited in claim 2 wherein said non-orthogonal array includes a plurality of horizontally extending paylines intersecting equal numbers of windows/locations arranged in alternating rows, horizontally offset relative to adjacent rows.

10. In a gaming apparatus as recited in claim 9 wherein said array further includes vertically extending paylines, alternating ones of which intersect equal numbers of windows/locations disposed in said horizontal paylines.

11. In a gaming apparatus as recited in claim 10 and further including inclined paylines angularly intersecting windows/locations contained in adjacent ones of said horizontally and vertically extending paylines.

12. In a gaming apparatus as recited in claim 2 wherein said non-orthogonal array includes a plurality of windows arranged in a star shaped array formed by the intersections of horizontal and inclined paylines wherein each point of the array is defined by at least three windows/locations, at least two of which lie along a horizontal or inclined payline.

13. A gaming apparatus comprising:

means forming a gaming play field including a plurality of gaming elements disposed in a non-orthogonal array, each said element including at least one gaming symbol displayable in at least a first display state and a second display state;

means defining a plurality of paylines each intersecting a different plurality of said gaming elements, each said payline defining a gaming proposition in which the state of the displayed symbols when compared to a paytable, defines a player's winnings;

means for enabling selection of one or more of said paylines means for causing said gaming symbols to change states and randomly assume one of said display states; and means for comparing the symbols displayed along each selected payline to said pay table and for generating a corresponding payout award.

14. A gaming apparatus as recited in claim 13 wherein said plurality of paylines includes horizontally extending paylines lying parallel to each other, and inclined paylines intersecting said horizontal paylines.

15. A gaming apparatus as recited in claim 14 wherein said plurality of paylines further includes vertically extending paylines intersecting junctions of said horizontal and inclined paylines.

16. A gaming apparatus as recited in claim 13 and further comprising means for enabling a player to select special payout opportunities based upon certain positional relationships between various ones of the elements and their displayed symbols.

17. A method of providing a gaming display for use in a gaming apparatus comprising the steps of:

providing a plurality of individually driven real or virtual symbol carrying elements disposed in a non-orthogonal positional array;

providing a plurality of individually selectable paylines respectively intersecting different combinations of said elements of said array, and enabling a player to select one or more of said paylines whereby the outcome of a gaming sequence using said display is a function of the symbols displayed along a selected one or more of said paylines.

18. lt A method of providing a gaming display as recited in claim 17 wherein said plurality of paylines includes horizontally extending paylines lying parallel to each other, and inclined paylines intersecting said horizontal paylines.

19. A method of providing a display as recited in claim 18 wherein said plurality of paylines further includes vertically extending paylines intersecting junctions of said horizontal and inclined paylines.

20. A method of providing a display as recited in claim 17 and further including the step of enabling a player to select special payout opportunities based upon certain positional relationships between various ones of the elements and their displayed symbols.

* * * * *